US005216466A

United States Patent [19]

Mitani

[11] Patent Number: 5,216,466

[45] Date of Patent: Jun. 1, 1993

[54] ELECTROPHOTOGRAPHIC RECORDING APPARATUS AND SYSTEM INCLUDING A DIELECTRIC BELT AND TRANSFER AND FIXING MEANS

[75] Inventor: Masao Mitani, Ibaraki, Japan

[73] Assignee: Hitachi Koki Co., Ltd., Tokyo, Japan

[21] Appl. No.: 858,088

[22] Filed: Mar. 26, 1992

[30] Foreign Application Priority Data

Mar. 29, 1991 [JP] Japan ..... 3-66366
Jul. 1, 1991 [JP] Japan ..... 3-160215

[51] Int. Cl.[5] ..... G03G 5/00

[52] U.S. Cl. ..... 355/211; 346/157; 355/271; 355/326

[58] Field of Search ..... 355/271, 275, 279, 281, 355/326, 327, 210–212, 217; 346/157; 118/645

[56] References Cited

U.S. PATENT DOCUMENTS

| | | | |
|---|---|---|---|
| 3,890,040 | 6/1975 | Schmidlin | 355/212 |
| 3,923,392 | 12/1975 | Buchan et al. | 355/271 |
| 3,947,113 | 3/1976 | Buchan et al. | 355/271 |
| 4,341,455 | 7/1982 | Fedder | 355/275 X |
| 4,408,864 | 10/1983 | Hardenbrook | 355/217 |
| 4,455,079 | 6/1984 | Miwa et al. | 355/279 |
| 4,918,487 | 4/1990 | Coulter, Jr. | 355/256 |
| 4,994,855 | 2/1991 | Ohashi et al. | 355/217 X |
| 5,053,821 | 10/1991 | Kunugi et al. | 355/326 X |

FOREIGN PATENT DOCUMENTS

| | | |
|---|---|---|
| 2704591 | 8/1978 | Fed. Rep. of Germany . |
| 52-145044 | 12/1977 | Japan . |
| 63-296078 | 12/1988 | Japan . |
| 2-158783 | 6/1990 | Japan . |

*Primary Examiner*—A. T. Grimley
*Assistant Examiner*—William J. Royer
*Attorney, Agent, or Firm*—Sughrue, Mion, Zinn, Macpeak & Seas

[57] ABSTRACT

In the improved electrophotographic recording apparatus, exposure is performed on a photoreceptor drum 7 in response to a signal from an optical head 13 provided in the vicinity of the drum 7, a thin endless metal belt 4 having a dielectric layer on the outer surface being brought into contact with the drum 7 so as to form an electrostatic latent image on the belt 4 and, thereafter, the latent image being developed with a toner 9 to produce a toner image which is then transferred onto a transfer medium 10 and permanently fixed to record the final image. This apparatus is free from deterioration of the photoreceptor and it is only the toner which is one of the consumables that needs maintenance, thereby reducing not only the economic burden on the part of the user but also the number of parts or components. Two or more units of this apparatus may be arranged in series in a geometric pattern to construct a multi-color printing electrophotographic recording system.

10 Claims, 7 Drawing Sheets

ELECTROPHOTOGRAPHIC RECORDING APPARATUS AND SYSTEM INCLUDING A DIELECTRIC BELT AND TRANSFER AND FIXING MEANS

BACKGROUND OF THE INVENTION

This invention relates to an electrophotographic recording apparatus or system that is suitable for use in copiers, facsimile equipment, printers or combinations thereof.

Electrophotographic data recording is commonly practiced in such applications as the output devices of main frames and personal computers and image duplicating copiers and this has contributed to the availability at low cost of high-quality hard copies. Particularly, in low-speed applications where machines operating at a comparatively slow speed have gained increasing acceptance in the past several years, cassette-type models which contain the developing unit, cleaner and other devices around the photoreceptor in one module are expanding the share of market taking advantage of the ease in their maintenance. However, the cassette-type models have many components to be replaced and even in the case where only the toner need be replenished, other parts such as the photoreceptor drum, the developing unit and the cleaner must also be replaced and this has increased the maintenance cost by at least several times as much as would otherwise be required.

The major parts or components that need frequent maintenance in conventional electrophotographic recording apparatus or systems are summarized below.

(1) The photoreceptor has a comparatively short life and needs frequent replacements by a serviceman. Major causes of its short life include not only deterioration due to exposure and ozone but also soiling, damage and wear due to components disposed around the photoreceptor such as the developing unit, transfer unit (including contact with the transfer medium), stripping fingers and cleaner, as well as sensitivity deterioration caused by those phenomena.

(2) In the heat roller system which is one of the most common methods adopted by the fixing unit, the replenishment of the anti-offset silicone oil, cleaning and, optionally, the replacement of the pressure rollers are necessary.

(3) Cleaning is also necessary to insure that the toner particles flying about will not build up on the recording paper to foul it; and (4) The replenishment of the spent toner.

SUMMARY OF THE INVENTION

An object of the present invention is to eliminate the aforementioned problems (1) to (3) and insure that only the toner which is one of the consumables needs maintenance, thereby providing an electrostatic recording apparatus that not only achieves a drastic decrease in economic burden on the part of the user but also eliminates an environmental problem by drastically reducing the emission of waste materials.

An other object of the present invention is to provide not only a new electrostatic recording apparatus that uses a smaller number of parts or components but also a color electrophotographic recording system that is compact, lightweight and capable of easy maintenance by general users who are laymen. Conventional systems have been very bulky and heavy and, at the same time, are so complex mechanically that they have required maintenance by skilled engineers.

These objects of the present invention can be attained in its first aspect by an electrophotographic recording apparatus in which exposure is performed on a photoreceptor having a photoconductive light-sensitive layer in response to a signal from an optical head provided in the vicinity of said photoreceptor, a dielectric belt including a thin endless metal belt having a dielectric layer on the outer peripheral surface is brought into contact with said photoreceptor so as to form an electrostatic latent image on the dielectric metal belt in successive correspondence with an image on said photoreceptor and, thereafter, the latent image is developed with a toner to produce a toner image which is then transferred onto a transfer medium and permanently fixed to record a final image.

In its second aspect, the present invention attains the aforementioned objects by a multi-color electrophotographic recording system in which two or more units of said electrophotographic recording apparatus are arranged in series in a geometric pattern.

In accordance with the first aspect of the present invention, a uniform charge layer is formed on the surface of the photoreceptor by a suitable means such as a corona charging device; the photoreceptor is then exposed to light from an optical head to form an electrostatic latent image. The dielectric belt that is either grounded electrically or supplied with a bias voltage is driven by a rotating roller to run in synchronism with the photoreceptor as it is urged against the latter. As a result, the electrostatic latent image is transferred to the surface of the dielectric belt. Since the photoreceptor is simply subjected to the repetition of the steps described above, it is entirely free from the problems of fouling, damage and wear which have frequently occurred in the prior art system and, hence, the life of the photoreceptor is markedly extended. In other words, the photoreceptor needs neither replacement nor maintenance.

The electrostatic latent image transferred onto the dielectric belt is then developed with the developing unit to form a toner image. If the dielectric belt is allowed to run in synchronism with the recording paper as it is pressed against the latter from the back side by means of an integral heating/cooling unit, whereupon the toner image on the dielectric belt is immediately fused by said belt having high heat conductivity to be impregnated into the recording paper. Immediately thereafter, the fused toner is cooled and at the time when it acquires adequate viscosity, the recording paper is stripped from the dielectric belt. Since the recording paper is stripped only after the viscosity of the toner has become adequately high, there will be no residual toner particles left on the dielectric belt.

Thus, the aforementioned problems (1) and (2) with the prior art can be completely solved by the present invention and the number of necessary components or parts is drastically reduced. As a natural consequence, the problem (3) is also reduced to such an extent that one may well say that it is substantially eliminated. Therefore, the only maintenance job that is necessary is to replenish the toner which is one of the consumables, whereby the aforementioned objects of the present invention are successfully attained.

DETAILED DESCRIPTION OF THE PREFERRED EMBODIMENTS

Figure 2:
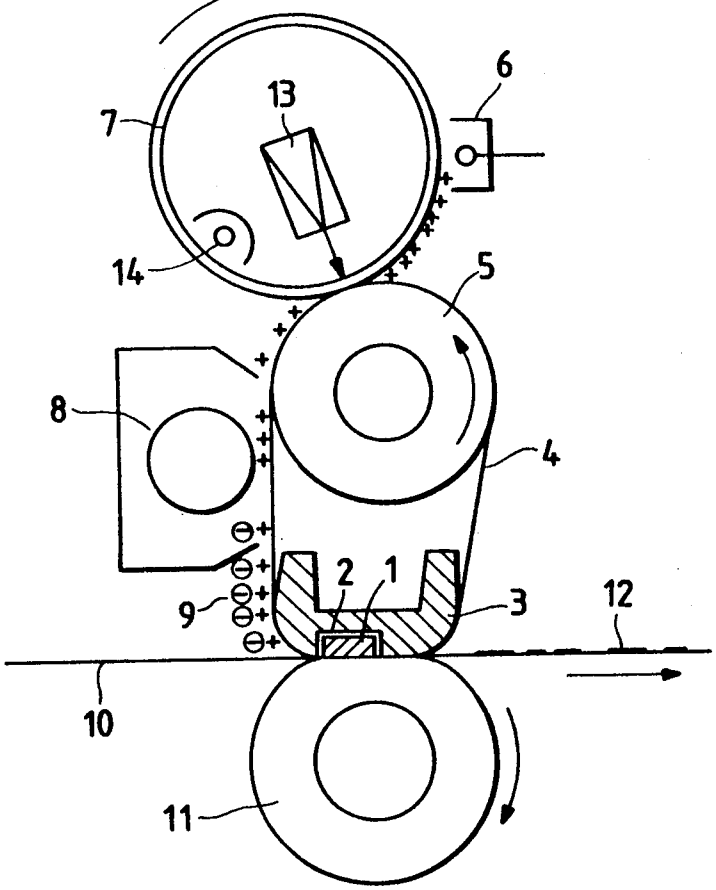
FIG. 2 is a diagram showing schematically a general layout for an electrophotographic recording apparatus according to another embodiment of the present invention in its first aspect.

As is well known in the art, there are two conventional methods for forming an electrostatic latent image on a sheet of electrostatic transfer paper having a thin dielectric layer: a sequential latent image transfer technique and a simultaneous latent image transfer technique (see the review article by Jono et al., "Senzo-tensha-gata Fukusha Hoshiki (Duplication Method of Latent Image Transfer Type)" in Denshi Shashin Gakkaishi, Journal of the Society of Electrophotography of Japan, Vol. 17, No. 3, 1979). A hybrid method which may as well be named a "sequential/simultaneous latent image transfer technique" has also been proposed (see R.L. Jepsen and G.F. Day: 2nd Intern. Conf. on Electrophotography, SPSE (1974), p. 28, and U.S. Pat. No. 3,751,157). All of these methods rely upon the formation of an electrostatic latent image on electrostatic transfer paper and the image as developed with a toner is immediately fixed. Hence, special paper has been necessary as the recording paper. In addition, there has been a problem in association with writability. Under the circumstances, the methods described above have not gained wide acceptance. As a further problem, the electrostatic recording paper has such large surface asperities (0–30 μm) that variations in transfer potential due to aerial discharge have often caused a substantial unevenness in image density.

In the present invention, we replaced the conventional electrostatic recording paper with an endless metal belt having a smooth-surfaced dielectric layer and devised a new fourth method for forming an electrostatic latent image on the metal belt furnished with the dielectric layer. This method is similar to the "sequential/simultaneous latent image transfer technique" and its details are described hereinafter. As a subsequent process, we invented a method in which the electrostatic latent image formed on the metal belt furnished with the dielectric layer was developed with a toner to produce a toner image which was transferred and fixed on a transfer medium simultaneously in a single step. The first aspect of the present invention falls in the category of this method and the transfer medium to be used may basically be of any type selected from plain paper, OHP sheets, recycled products from waste paper, envelope paper, etc.

In the first aspect of the present invention, a transparent substrate coated with a clear electroconductive film and provided with a photoconductive light-sensitive layer on the outer peripheral surface may be used as a photoreceptor, with a voltage applied between said clear electroconductive film and the dielectric metal belt while exposing light from the optical head is applied to the side of the photoreceptor which is opposite the side where it contacts the dielectric belt, so as to form an electrostatic latent image on said dielectric belt. In this embodiment, there is no need to use a corona charging device. Hence, a generator of a high voltage of ca. 6,000 V that would otherwise be necessary in operating the charging device is also obviated. On the other hand, what must be provided additionally is no more than a generator of a bias voltage of several hundred volts and this contributes to a further simplification of the mechanism of the recording apparatus. In this respect (elimination of the need for using a corona charging device), the first aspect of the present invention is the same as the invention described in U.S. Pat. No. 3,751,157, supra. However, the invention described in this U.S. patent adopts a method of recording on specialty paper, or electrostatic recording paper that has large surface asperities. In contrast, the first aspect of the present invention uses a dielectric belt having a smooth surface, so it insures intimate contact (gap $\leqq 1$ μm) between the photoreceptor and the metal belt and the mechanism of charge emission is by field emission, thereby accomplishing a very efficient transfer of static charges. In addition, the dielectric belt is used as an intermediate recording medium, so recording can be made on various kinds of paper including plain paper.

The most characterizing part of the electrophotographic recording apparatus according to the first aspect of the present invention is that the whole process of recording on the transfer medium is completed by a single step of simultaneously performing transfer and fixing operations and that it has a capability for transporting the transfer medium smoothly as it is held in a flat state. Therefore, one will readily understand that the second aspect of the present invention in which two or more units of the recording apparatus described above are connected linearly can provide a color electrophotographic recording system that is compact, lightweight and easy to service.

It should also be noted that the life of the photoreceptor drum and other components of the apparatus or system of the present invention is markedly increased to such an extent that the only part that needs replacements is the toner which is one of the consumables.

Various embodiments of the present invention are described below with reference to the accompanying drawings.

First Embodiment

Figure 1:
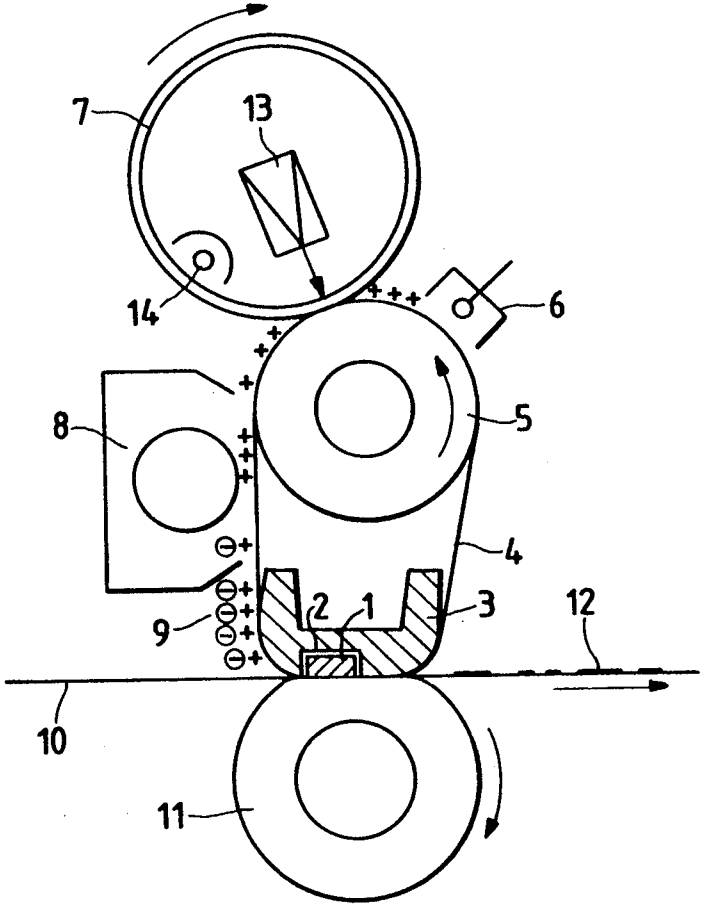
FIG. 1 is a diagram showing schematically a general layout for an electrophotographic recording apparatus according to an embodiment of the present invention in its first aspect.

FIG. 1 is a cross section of an electrophotographic recording apparatus according to an embodiment of the first aspect of the present invention. Shown by 7 is a photoreceptor drum that typically comprises a glass cylinder that has a clear electroconductive film formed on the surface, with a thin insulating blocking layer and an organic photoconductive light-sensitive layer being formed on the outer peripheral surface by a conventional method. If desired, a light-shielding material of the type described in commonly assigned Japanese Patent Application No. 115045/1990 ("Electrophotographic recording apparatus") may be coated to form the outermost layer with respect to the organic photoconductive light-sensitive layer so that the photoreceptor on the drum 7 will have sensitivity only to the exposing light coming from within the drum but not to extraneous light. In this case, the apparatus shown in FIG. 1 is designed so that there will be no leakage of light into the photoreceptor drum 7 and, hence, there is no particular need for providing a light-shielding means and the apparatus can be constructed in such a way that the recording procedure can be seen from the outside.

The formation of an electrostatic latent image, its development with a toner, as well as the transfer and fixing of the resulting toner image on the recording paper are accomplished principally by means of the heat roller unit shown in FIG. 1 (that consists of a heater 1, heat insulator 2, a cooling structure 3, a dielectric belt 4 and a drive roller 5) and a pressure roller 11. These components are basically the same as those of the thermal fixing unit described in commonly assigned Japanese Patent Application Nos. 293986/1990, 339079/1990 and 49392/1991.

The dielectric belt 4 is typically an endless metal belt of a two-layered structure that consists of an Ni metal belt 30 μm thick having a fluorine resin (PTFE) coat that is formed in a thickness of 10–20 μm on the outer surface and that contains highly dielectric fine particles. This metal belt 4 is connected electrically to the clear electroconductive film (not shown) on the photoreceptor drum 7. The metal belt 4 is stretched around both an integral heating/cooling unit (composed of the heater 1, the heat insulator 2 and the cooling structure 3) and the drive roller 5, so that it is driven rotatably. The integral heating/cooling unit is composed of the cooling structure 3 having a generally H-shaped cross section, the heater 1 which is buried in the cooling structure 3 on the side facing the pressure roller 11, and the heat insulator 2 held between the heater 1 and the cooling structure 3. Since the cooling structure 3 is made of a good heat conductor such as aluminum, the metal belt 4 heated with the heater 1 is cooled rapidly with the cooling structure 3.

The operation of the apparatus shown in FIG. 1 will proceed as follows. First, a uniform charge layer is formed on the outer surface of the dielectric metal belt 4 by means of the corona charging device 6. When the metal belt 4 carrying this charge layer contacts the photoreceptor drum 7, that part of the photoreceptor drum 7 which has been illuminated with light from an exposing unit 13 comprised of either an LED array or a liquid-crystal shutter equipped with a lamp will conduct. As a result, the electric charges on the dielectric metal belt 4 will disappear and only those charges in the unilluminated areas will remain on the metal belt 4 to form an electrostatic latent image. This latent image is developed with a developing unit 8 to produce a toner image, which is transported to pass between the integral heating/cooling unit and the pressure roller 11 together with recording paper 10.

As the toner image is transported through this area, the toner particles are first fused with the heater 1 and the fused toner particles will be impregnated in the surface of the recording paper 10 under the pressure exerted by the pressure roller 11. In the second half of the integral heating/cooling unit (as seen in the direction of paper transport), the dielectric metal belt 4 is cooled and the temperature of the fused toner will also decrease. In an experiment conducted by the present inventors, the fused toner particles on the side facing the fluorine resin layer experienced the greatest drop in temperature and the recording paper 10 (stated more correctly, the partly fused toner particles) separated effectively from the dielectric metal belt 4 to achieve complete prevention of offsetting. The electrostatic attraction working between the metal belt 4 and the recording paper 10 as they were separated from each other was found to be smaller than in the case where such separation occurred following transfer of the toner image in the conventional electrophotographic apparatus. This would be because the electric charges on the dielectric belt 4 moved to the fused toner particles to achieve neutralization in the fixing step. There is no particular need to erase the residual charges on the metal belt 4 after the transfer of toner image. However, better results were obtained when some charges that moved to the photoreceptor drum 7 were erased with an erase lamp 14.

The corona charging device 6 shown in FIG. 1 assumes positive charging but this is also related to the photoreceptor material used on the drum 7, as well as its composition. If an organic photoreceptor material is to be used, its composition is limited to a single-layered structure, a fine crystal dispersed structure or an inverted multi-layered structure. Needless to say, negative corona charging may be effected and, in this case, the layer arrangement of the organic photoreceptor material is either a multi-layered structure or a fine crystal dispersed structure; it is also necessary that the flexibility or deformability of the drive roller 5 be rendered great enough to insure that the photoreceptor drum 7 will contact the dielectric belt 4 for a period of 0.1–0.2 second after exposure depending upon the mobility of positive holes.

A method that also proved to be effective in practice was providing a potential difference between the clear electroconductive film on the photoreceptor drum 7 and the dielectric belt 4 so as to minimize the quantity of electrostatic transfer onto the photoreceptor drum 7 in the unilluminated areas.

In the apparatus shown in FIG. 1, the photoreceptor drum 7 is not subjected to corona charging and excepting light fatigue, there is no basic factor that causes deterioration in the photoreceptor. As a matter of fact, the photoreceptor could be used in practice for an almost indefinite period.

The life of the dielectric belt 4 was almost indefinite and the occurrence of wear or deterioration in the fluorine resin was hardly noticeable.

Another characteristic feature of the embodiment under consideration is that the recording paper is subjected to only one step of simultaneous transfer and fixing operations and that yet the recording paper need only to be transported in a flat path without being bent at all. In addition, the process efficiency is hardly dependent on the thickness and quality of the recording paper and even a plurality of sheets that are superposed and glued together as in the case of document envelopes which have heretofore defined printing can be used as recording paper to achieve printing without producing wrinkles and other defects.

In order to reduce the manufacturing cost, the glass cylinder as the basic component of the photoreceptor drum 7 was prepared by the Danner process which is commonly used in producing glass tubes for fluorescent lamps. Hence, the glass cylinder had such a high degree of roundness and linearity that it suffered from a waviness of approximately ±15 μm and the drive roller 5 was designed to have a sufficient deformability or flexibility to conform to that amount of waviness. Needless to say, the present inventors already verified that said waviness and deformability would not cause any problems such as image deterioration and shorter life. As a further advantage, the pressure roller 11 will be compressed to deform in a smaller amount than is the conventional heat roller, so the life of this pressure roller is remarkably increased to such an extent that it practically needs no replacements, which is another outstanding feature of the system shown in FIG. 1.

Second Embodiment

Another embodiment of the first aspect of the present invention is shown in FIG. 2. In this embodiment, a charge layer is formed on the photoreceptor drum 7 by means of a corona charging device 6 and illuminated with light from an optical head 13 to form an electrostatic latent image which is subsequently transferred to a dielectric belt 4. The optical head 13 shown in FIG. 2 is positioned in such a way that the light it issues is incident at the point of contact between the metal belt 4 and the photoreceptor drum 7 but, needless to say, a similar result will be attained even if the optical head 13 is positioned more upstream of the direction in which the photoreceptor drum 7 rotates (i.e., in a position closer to the corona charging device 6). The recording and fixing operations conducted in the second embodiment, as well as the performance achieved are completely the same as in the first embodiment and, hence, will not be described in detail. In the second embodiment, too, the useful life of the photoreceptor was almost indefinite since the only factor that would contribute to its deterioration was the application of corona charging.

Third Embodiment

Figure 3:
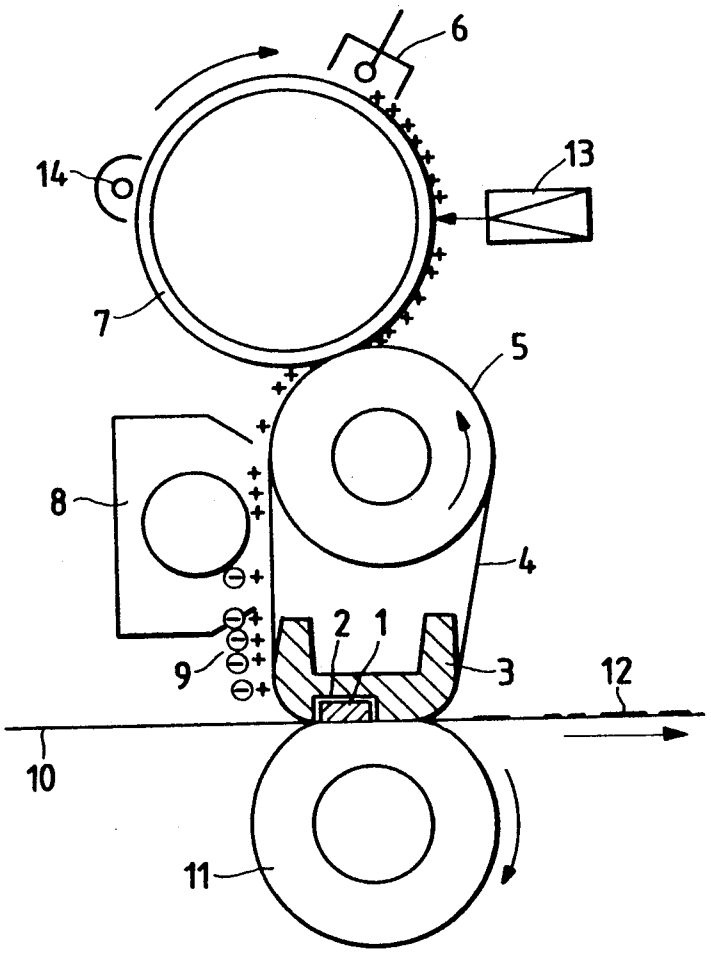
FIG. 3 is a diagram showing schematically a general layout for an electrophotographic recording apparatus according to still another embodiment of the present invention in its first aspect.

Yet another embodiment of the first aspect of the present invention is shown in FIG. 3. In this embodiment, the base of a photoreceptor drum 7 was an aluminum cylinder as in the prior art system, with an optical head 13 and an erase lamp 14 being disposed exterior to the photoreceptor drum 7. This embodiment produced completely the same characteristics as the second embodiment.

Fourth Embodiment

Figure 4:
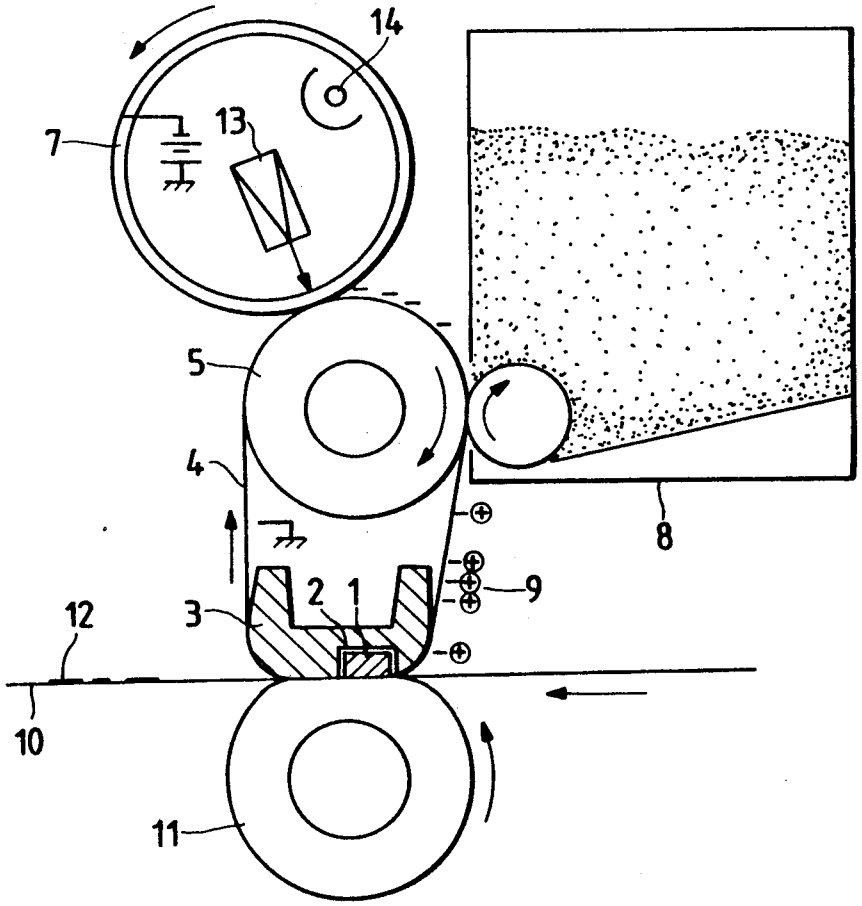
FIG. 4 is a diagram showing schematically a general layout for an electrophotographic recording apparatus according to yet another embodiment of the present invention in its first aspect.

FIG. 4 is a cross-sectional view of an electrophotographic recording apparatus according to a further embodiment of the first aspect of the present invention. The formation of an electrostatic latent image on the dielectric belt 4, its development with a toner, as well as the transfer and fixation of the resulting toner image on the recording paper were accomplished by a mechanism that was essentially the same as in the first embodiment and which was composed of the heat roller unit shown in FIG. 1 (consisting of the heater 1, heat insulator 2, cooling structure 3, dielectric metal belt 4 and drive roller 5), pressure roller 11, photoreceptor drum 7 and optical head 13.

A bias voltage of ca. 600 V was applied between the dielectric belt 4 and the clear electroconductive film (to be described hereinafter) on the photoreceptor drum 7. Since the application of this bias voltage contributed to the formation of an electrostatic latent image on the dielectric belt 4, there was no need for providing a corona charging device. The cooling structure 3 was made of a good heat conductor such as aluminum, so the dielectric belt 4 heated with the heater 1 could be rapidly cooled with the cooling structure 3. Thus, the surface of the dielectric layer on the metal belt 4 had such a temperature profile that a maximum temperature of, say, 140° C. occurred at a point slightly off the center towards the exit end of the integral heating/cooling unit composed of the heat insulator 2 and the cooling structure 3 whereas the temperature was below 100° C in the vicinity of the exit end. The maximum and minimum temperatures and the temperature profile, as well as the nip width must be determined in relation to the melting point of the toner used and other physical data of interest but their margins are incomparably wider than in the case of the conventional heat rollers and the fact that the toner was not offset to the dielectric belt 4 having an insulating fluorine resin charged to ca. 200 volts obviously shows the effectiveness of good separation of the recording paper carrying the toner image from the cooled dielectric belt. Needless to say, the charges on the toner particles and the charges of opposite polarity that have built up on the dielectric belt 4 will combine to cause neutralization when the recording paper carrying the toner image is separated from the metal belt and this also works effectively in preventing the occurrence of offsetting. The pressure roller 11 is rotated in synchronism with the metal belt 4 to insure that the transfer medium 10 would be brought into intimate contact with the metal belt 4. The toner particles as supplied from the developing unit 8 would be deposited electrostatically on the metal belt 4, thereby forming an electrostatic latent image.

In the fourth embodiment, the process by which the electrostatic latent image formed on the dielectric belt 4 was developed with a toner to produce a toner image 9 which was transferred and fixed simultaneously on the transfer medium 10 is the same as in the first embodiment and, hence, will not be described in detail. Hereinafter, only the process of forming an electrostatic image is discussed with reference to FIG. 5.

Figure 5:
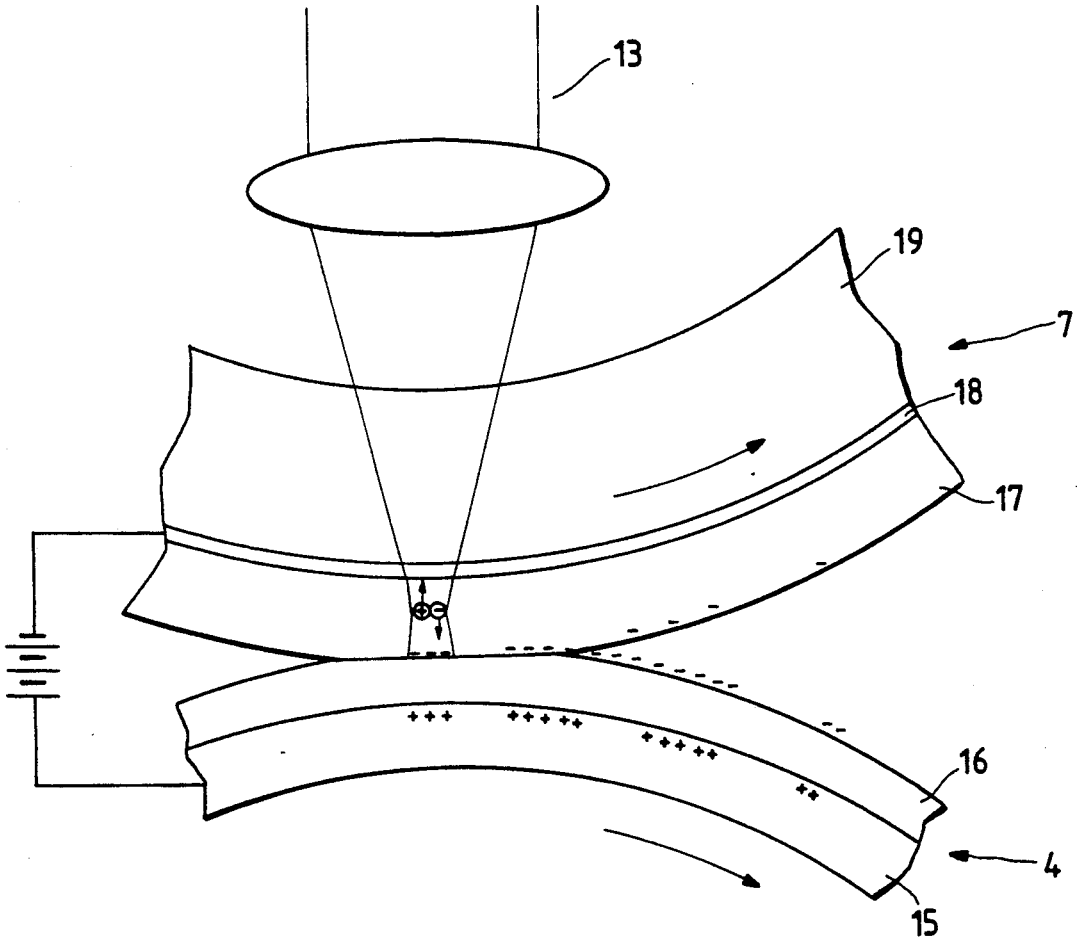
FIG. 5 is a diagrammatic view illustrating the narrow-gap sequential latent image transfer method that may be adopted in the fourth embodiment of the present invention in its first aspect.

As shown in FIG. 5, the dielectric belt 4 has a two-layer structure that consists of a metal belt 15 and a dielectric layer 16. The photoreceptor drum 7 has a fourlayer structure that consists of a transparent glass cylinder 19, a clear electroconductive film 18, a thin (1,000–2,000 A) insulating blocking layer (not shown) and an organic photoreceptor layer 17. Although not shown in FIG. 5, a clear electroconductive film was also coated on the inner surface of the glass cylinder 19 and grounded electrically, which proved to be a very effective method for preventing the interference with exposure due to the deposition of dirt or dust particles.

The organic photoreceptor 17 may be designed as a dual structure consisting of a charge generation layer and a charge transport layer. The exposing unit 13 was positioned in such a way that the light it issued would pass through the glass cylinder 19 to produce a focused beam spot on the organic photoreceptor 17. In the fourth embodiment, the beam spot had a diameter of ca. 80 μm but, if necessary, a narrower beam spot may be produced to achieve a higher resolution.

In the fourth embodiment, the metal belt 15 as the basic component of the dielectric belt 4 is typically a pure Ni layer having a thickness of 30 μm and the dielectric layer 16 is typically a fluorine resin (PTFE) layer having a thickness of 10 μm The PTFE layer contains a $TiO_2$ powder having a particle size of 0.1 to 1 μm and its volume fraction is ca. 20%. The glass cylinder 19 is the same as a fluorescent lamp having a wall thickness of 0.8 mm and a diameter of 32 mm. The clear electroconductive film 18 was a DIP NESA film which was coated over the entire surface of the glass cylinder 19. The organic photoreceptor film 17 had a two-layered structure (of an inversed dual type) having a thickness of 30 μm but it may be of a single-layered type or a fine crystal dispersed type.

The glass tube 19 is made of an inexpensive type which is used for fluorescent lamps. The roundness and straightness of this glass tube is so good that even the largest waviness is within ±15 μm. Hence, in order to insure that the dielectric belt 4 makes intimate contact with the photoreceptor film 17 conforming to the surface waviness of the glass tube 19, the drive roller 5 is in the form of a metal roller having a coating of silicone rubber in a thickness of ca. 2 mm. This silicone rubber layer insures not only positive contact between the photoreceptor drum 7 and the dielectric belt 4 but also nonslip smooth rotational driving of the dielectric belt 4.

In another experiment conducted with the system described above, the present inventors confirmed that when the photoreceptor drum 7 was rotationally driven in synchronism with the dielectric belt 4, the organic photoreceptor film 17 on the drum 7 and the dielectric layer 16 on the endless metal belt 4 made intimate contact with each other over a width of about 3 mm (see FIG. 5). The area where this intimate contact starts is illuminated, in response to an image signal, with light from the exposing unit 13 that has been focused to form a beam spot of ca. 80 μm in diameter.

In the case where the organic photoreceptor 17 is not illuminated with light, no electric charges will be induced at the interface with the dielectric layer 16, nor will charges build up on the surface of the dielectric unless the bias voltage exceeds a certain limit since the organic photoreceptor film 17 is an insulator. On the other hand, if the organic photoreceptor film 17 is illuminated with light, electron-hole pairs will be generated in a number proportional to the intensity of the applied light and, in the case shown in FIG. 5, electrons will be accumulated on the surface of the organic photoreceptor film 17 in accordance with the applied bias voltage. Since the gap between the photoreceptor film 17 and the dielectric layer 16 is substantially zero, the greater part of the charges, as soon as they are accumulated, will move to the surface of the dielectric by a weak field emission and they will remain in the same state even if the photoreceptor film 17 and the dielectric layer 16 depart from each other as a result of rotation following the cessation of light illumination. Thus, an electrostatic latent image is efficiently formed on the surface of the dielectric belt 4.

The conditions for forming an electrostatic latent image in the process of the present invention are discussed below theoretically.

Figure 6:
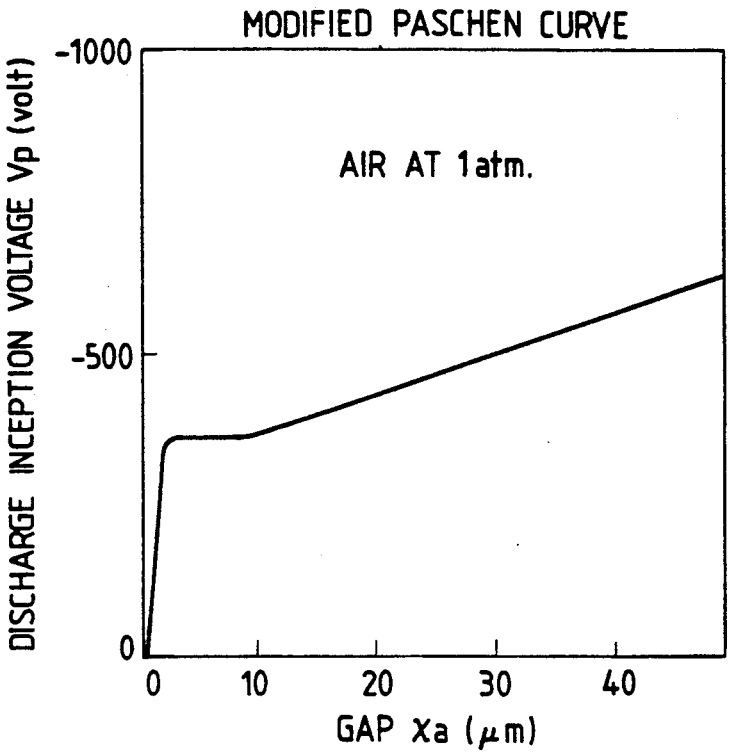
FIG. 6 is a diagram showing a known modified Paschen curve.

Consider first the case where the applied exposing light has an adequate strength and the organic photoreceptor film 17 can effectively be regarded as a conductor; then, the transfer potential $V_t^L$ is expressed by:

$$V_t^L = V_o - \frac{\chi_a + \chi_d}{\chi_a} V_p(\chi_a) \quad (1)$$

where $V_o$ is the bias voltage, $\chi_a$ is the gap distance between the organic photoreceptor film 17 and the dielectric layer 16, and $\chi_d$ which is generally referred to as the air layer equivalent thickness of the dielectric layer 16 is expressed by:

$$\chi_d = D_d/\epsilon_d \quad (2)$$

where $D_d$ is the thickness of the dielectric layer 16 and $\epsilon_d$ is the specific inductivity of the dielectric layer 16 ($\epsilon_d = 5$ in the embodiment under discussion). In Eq. (1), $V_p(\chi_a)$ represents the aerial discharge inception voltage as a function of $\chi_a$ and its profile is well known as a modified Paschen curve, which is depicted in FIG. 6 for the case where discharge is effected in air at one atmosphere. By approximation, the following data may be given:

$$V_p(\chi_a) = -200\chi_a, \quad \chi_a \leqq 1.8\ \mu m \quad (3)$$

$$V_p(\chi_a) = -(312 + 6.2\chi_a), \quad \chi_a \geqq 10\ \mu m \quad (4)$$

Also consider the case where the intensity of the applied exposing light in zero and the organic photoreceptor film 17 can effectively be regarded as in insulator; the transfer potential $V_t^D$ is then expressed by:

$$V_t^D = \frac{\chi_d}{\chi_d + \chi_p}\left[V_o - \frac{\chi_a + \chi_d + \chi_p}{\chi_a} V_p(\chi_a)\right] \quad (5)$$

where $\chi_p$ is the air layer equivalent thickness of the photoreceptor film 17 and expressed by:

$$\chi_p = D_p/\epsilon_p \quad (6)$$

where $D_p$ and $\epsilon_p$ represent the thickness and specific inductivity, respectively, of the photoreceptor film 17 ($\epsilon_p \simeq 3$ for the organic photoreceptor).

In the case of the experiment we conducted, $\chi_a$, or the gap between the organic photoreceptor film 17 and the dielectric layer 16 may be regarded as substantially zero during exposure, so the aerial discharge inception voltage $V_{p(\chi a)}$ is:

$$V_{p(\chi a)} = -200\chi_a \quad (7)$$

indicating that even if the applied exposing light is weak, charges are transferred by a degree that is proportional to the amount of exposure, thereby enabling an electrostatic latent image to be formed in a very efficient way.

Substituting the relevant values into Eq. (1), we obtained:

$$V_t^L = V_o + 400 + 200_{\chi a} \simeq V_o = 400 \quad (8)$$

The conditions to be satisfied for preventing the occurrence of electrostatic transfer when the intensity of the exposing light is zero is that $V_t^D$ should be zero irrespective of the value of gap $\chi_a$. Stated more specifically, Eq. (5) dictates that the voltage $V_o$ to be applied must be smaller than the minimum value of:

$$|V_o| = \frac{\chi_a + \chi_d + \chi_p}{\chi_a} |V_p(\chi_a)| \quad (9)$$

On the basis of FIG. 6 and by a simple calculation, the minimum value of $V_o$ is determined as follows:

$$|V_o|\min = 6.2 [\sqrt{(\chi_d + \chi_p)} + 7.1]^2 \quad (10)$$

In the embodiment under consideration, $\chi_d = 2$ and $\chi_p = 10$, so the minimum value of $V_o$ is calculated as:

$$|V_o| min = 692\ V \quad (11)$$

If $|V_o|$ is selected to have a smaller value than 692 V (e.g., $V_o = -600$ V), a calculation by Eq. (8) gives:

$$V_t^L = -200 \quad (12)$$

Obviously, a very sensitive electrostatic latent image can be formed and, at the same time, the unwanted "fogging" phenomenon can be completely suppressed.

The above consideration needs a more detailed analysis because in that description, $\chi_a$ nearly equal to zero during exposure but for practical purposes, it is important to evaluate the margin for that condition.

Figure 7:
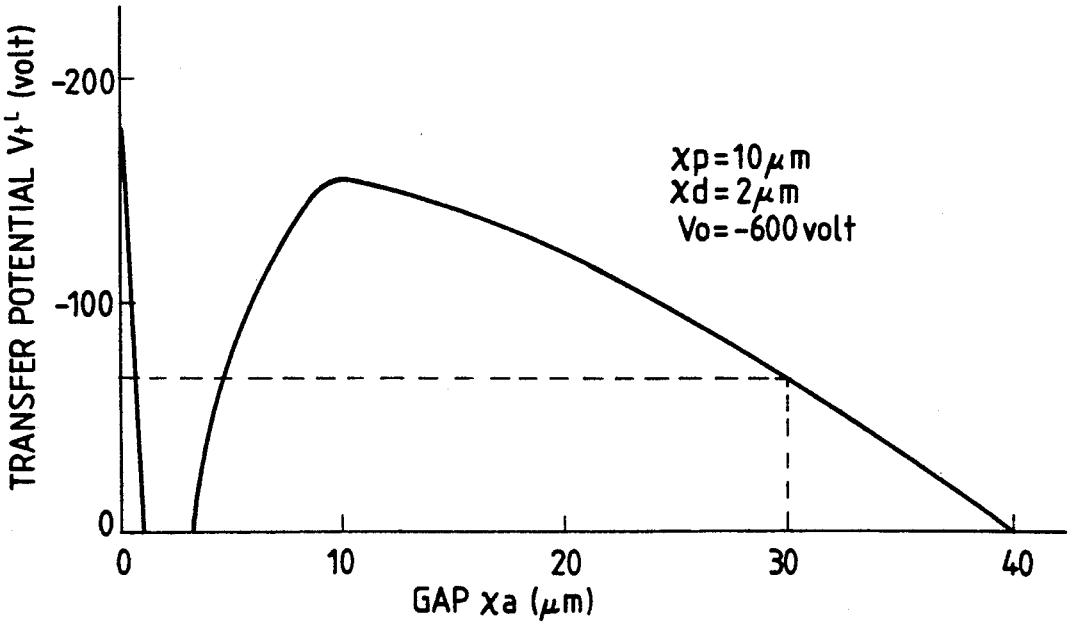
FIG. 7 is a transfer potential characteristic diagram for the fourth embodiment of the present invention in its first aspect.

First, assuming the construction shown in FIG. 5, the profile of transfer potential, $V_t^L$, after exposure vs $\chi_a$ is as depicted in FIG. 7 on the basis of Eq. (1) and FIG. 6. Stated more specifically, the potential for transfer to the surface of the dielectric layer 16 in proximity to the exposed organic photoreceptor film 17 is at a maximum when $\chi_a = 0$ (i.e., the dielectric layer 16 is in close contact with the photoreceptor film 17), with $V_t^L$ being $-200$ volts. On the other hand, if the two members are not in close contact with each other and if $\chi_a$ is in the range of 1 to 3 μm, there will be no charge transfer and $V_t^L$ is equal to zero. But even in this case, charges have built up on the surface of the organic photoreceptor film 17 and they will cause a field emission when the gap between the organic photoreceptor film 17 and the dielectric layer 16 increases as a result of rotation of the photoreceptor drum 7 and the dielectric belt 4, with the ultimate result being such that $V_t^L \simeq 150$ volts which is the transfer potential for $\chi_a = 10$ μm develops on the surface of the dielectric layer 16. As one can readily understand in view of the relationship with the bias voltage, the thus developed transfer potential $V_t^L$ which is approximately in the range of $-150$ to $-200$ volts will not undergo reverse transfer no matter what value the gap $\chi_a$ will later assume and the once attained value will be preserved throughout the subsequent stage. Thus, in accordance with the embodiment under consideration where it is possible to insure the gap $\chi_a \leqq 1$ μm, a gap distance $(\chi_a)$ approximately 10 μm will be attained by all means and the accomplishment of $V_t^L \simeq -150$ volts is guaranteed.

These results are in good agreement with the results of an actual experiment and satisfactory recording characteristics were exhibited when $V_o$ was within the range of from $-700$ (inclusive) to $-500$ volts (inclusive). Besides the very marked advantage of high sensitivity and contrast, the present invention has also proved to make a great contribution to a lower equipment cost by permitting a liquid-crystal shutter to be used satisfactorily as the exposing unit 13.

A word must be said about the differences between the method of the present invention and the prior art methods of latent image transfer (such as those described in R.L. Jepsen and G.F. Day: 2nd Intern. Conf. on Electrophotography SPSE (1974), p. 28, and U.S. Pat. No. 3,751,157). Needless to say, the biggest difference concerns the operating principle: in the prior art methods, specialty paper called "electrostatic paper" must be used in order to insure that an electrostatically transferred image is developed with a toner and subsequently fixed; on the other hand, in the foregoing embodiments of the present invention, electrostatic transfer and development are effected on an intermediate recording medium called the dielectric belt 4 and the developed image is transferred and fixed on plain paper by a single step. Another big difference concerns the image quality. In the prior art methods, the electrostatic recording paper having a thin dielectric layer ($\chi \simeq 2$ μm) coated on a sheet of paper fibers having large asperities is pressed strongly against the photoreceptor layer during exposure and electrostatic transfer and is thereafter stripped from the photoreceptor layer. On account of the surface asperities of the electrostatic recording paper, the gap $\chi_a$ takes on an average of 10 to 20 μm and will experience local variations of up to 30 μm, causing in-plane variations of $-200$ to $-70$ volts (see FIG. 7) in transfer potential that are great enough to affect the image quality. However, in the embodiment under consideration, the variation in transfer potential was reduced to about one third of the range for the prior art methods ($-200$ to $-150$ volts), thereby producing a very good image quality. Needless to say, the situation is entirely the same in the other embodiments of the present invention.

Fifth Embodiment

An apparatus of the same type as in the fourth embodiment was constructed except that the dielectric layer 16 was a fluorine resin layer containing about 10% of the powder (0.1–1 μm) of a material of high dielectric constant, say, an $SrTiO_3$-$PbTiO_3$-$Bi_2O_3$-$nTiO_2$ based material ($\epsilon \simeq 1{,}500$). This layer had a dielectric constant ($\epsilon_d$) of 40. Even when this fluorine resin layer was rendered to be as thick as 20 μm, $\chi_d$ could be reduced to as small as 0.5 μm. In this case, $V_t^L \simeq V_o + 100$ and $|V_o|$ min $= 663$ volts, so the bias voltage could be made even lower than what was achievable in the fourth embodiment (e.g., $V_o = -300$ volts) and, hence, the equipment design could be further simplified (to be operable on lower voltage). Obviously the accomplishment of this electrophotographic recording apparatus adapted for operation on a lower voltage will contribute two big advantages in practical applications, namely, increased safety and lower cost.

Sixth Embodiment

Figure 8:
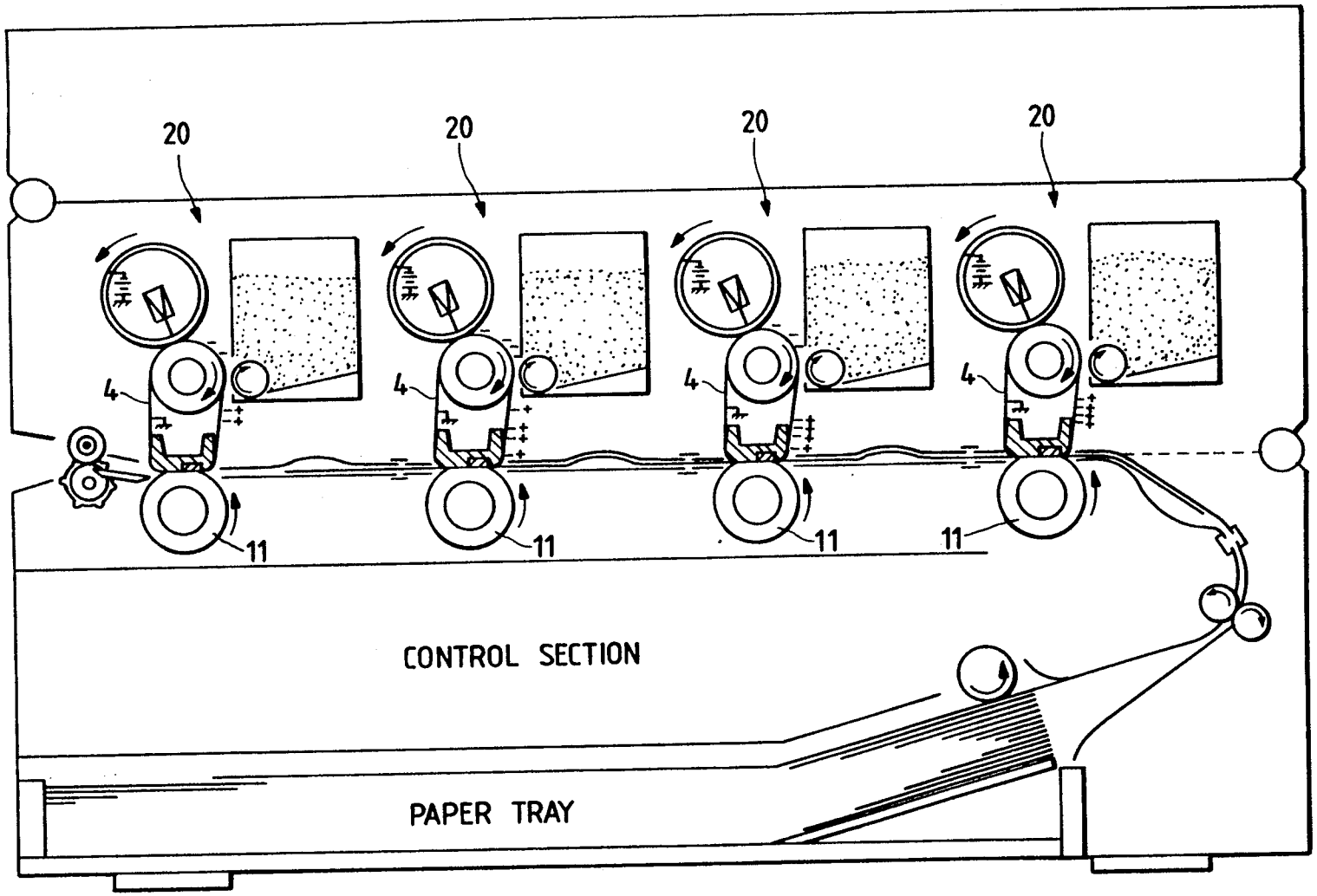
FIG. 8 is a diagram showing schematically a general layout for a multi-color printing electrophotographic recording system according to an embodiment of the present invention in its second aspect.

In this embodiment, the construction according to the fourth embodiment shown in FIG. 4 was adopted to manufacture a multi-color printing electrophotographic recording system as shown in FIG. 8. The system shown in FIG. 8 is designed for printing in four full colors, magenta, cyan, yellow and black but, as one can see, various design modifications can be easily made to reproduce black plus one color or black plus two colors. Except in the case of full color reproduction that requires particularly high precision in color matching positions, the system shown in FIG. 8 will easily accomplish multi-color printing on plain paper.

Figure 10:
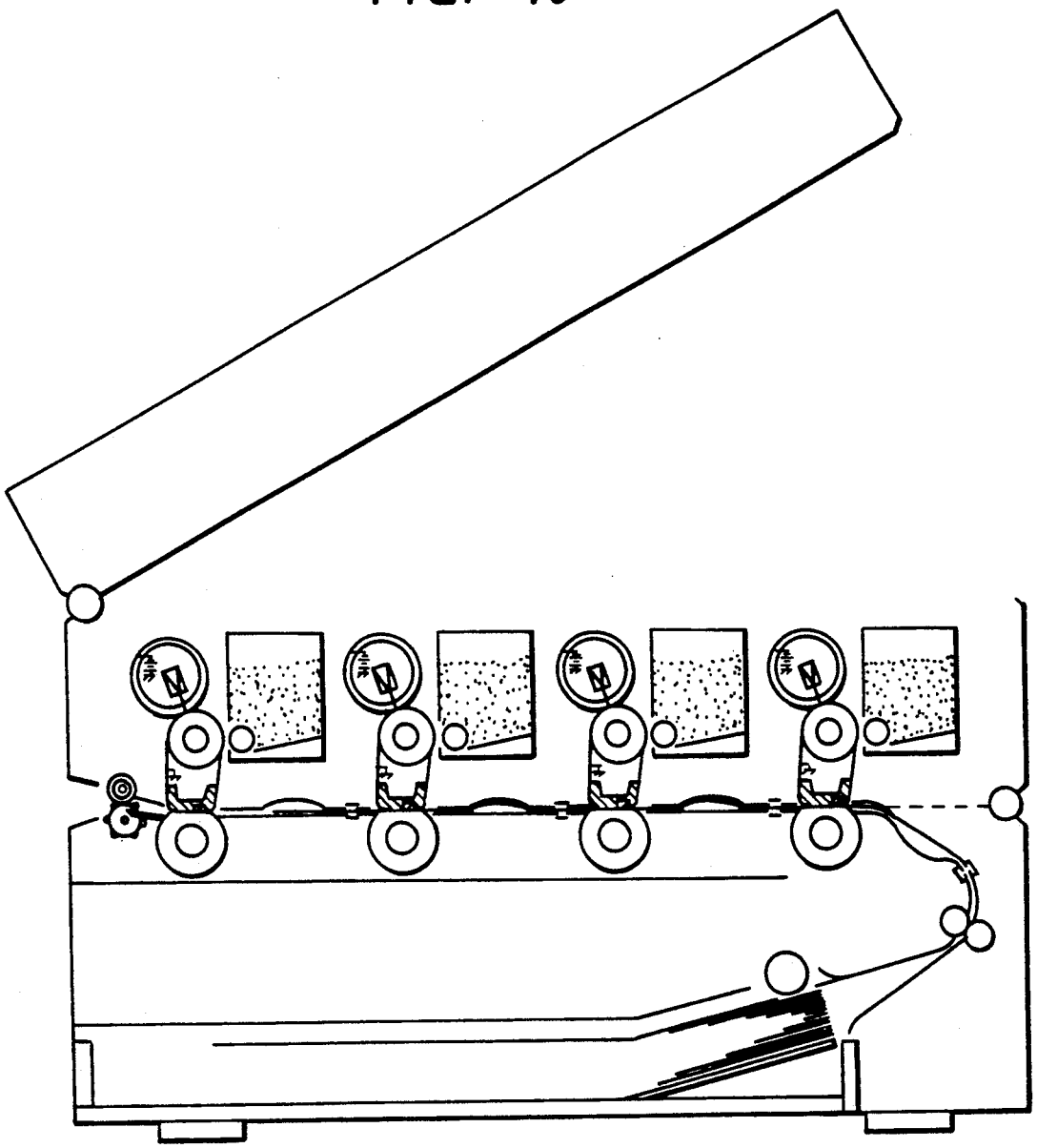
FIG. 10 is a diagram showing a method of maintenance that may be adopted for replacing the toner in the system shown in FIG. 8.

As one will see, the color copier shown in FIG. 8, in which a plurality of units of the monochromatic recording apparatus 20 shown in FIG. 4 according to the fourth embodiment of the present invention in its first aspect are connected lineally, provides great ease in maintenance for various reasons. First, the components of each monochromatic recording unit 20 have such a prolonged service life that they are practically replacement-free and the only requirement for maintenance is the replenishment of toner which is one of the consumables. Toner replenishment or the replacement of a used toner box can be readily done by lifting the READ section of the system as depicted in FIG. 10.

Figure 9:
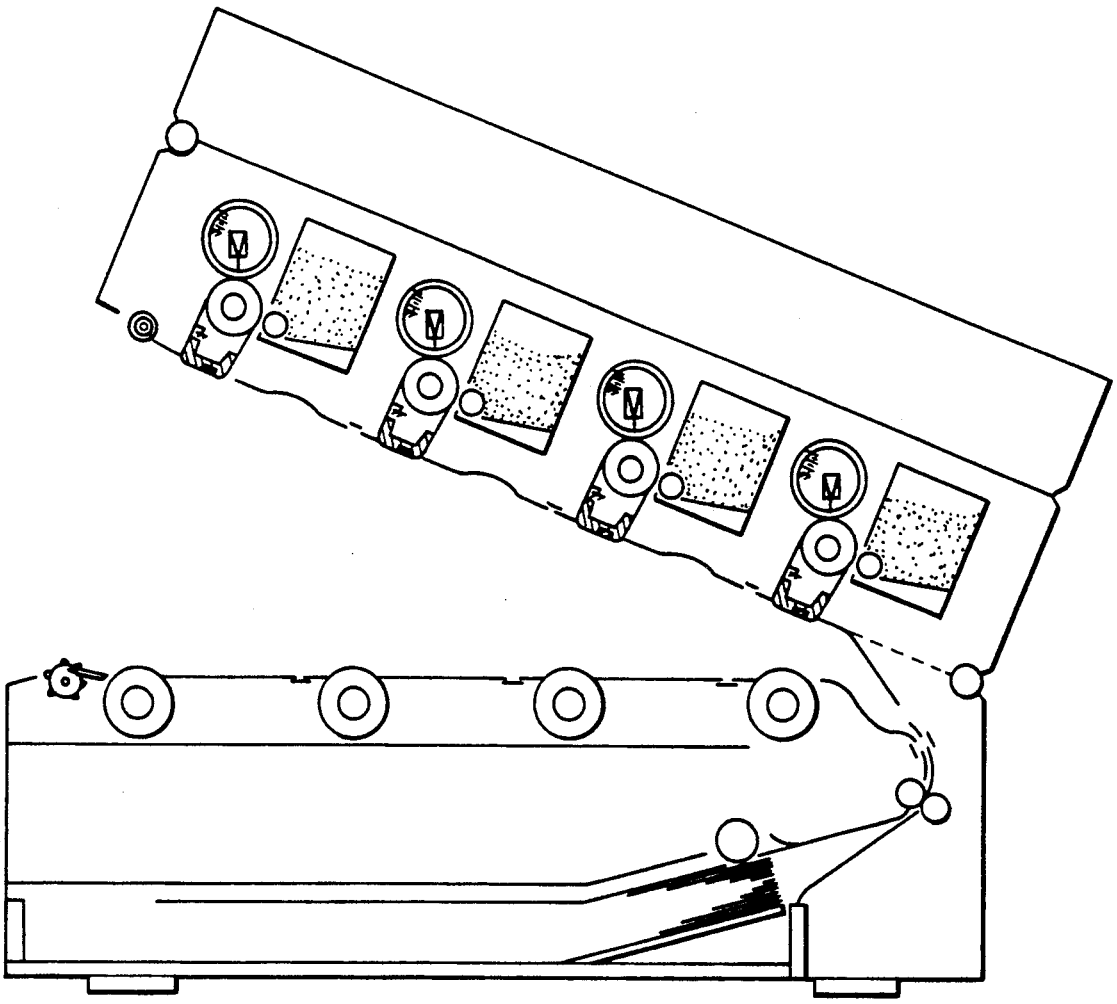
FIG. 9 is a diagram showing a method of maintenance that may be adopted when the paper is jammed in the system shown in FIG. 8.

If the paper is jammed, one can readily take a corrective measure by lifting part of the system as separated along the plane of contact between the dielectric belts 4 and the pressure rollers 11 as shown in FIG. 9. This simplicity in the procedure of maintenance work is attributable to the fact that a plurality of units of the monochromatic recording apparatus 20 can be arranged lineally in accordance with the second aspect of the present invention.

The most characteristic feature of the color printing method implemented by the apparatus shown in FIG. 8 is that it completes the printing of individual colors to have them printed successively one on another. This is an entirely new approach and can be modified in such a way as to perform sequential printing using toners in the decreasing order of melting point, thereby preventing the mixing of colors. A positive application of this modified method is such that the melting point of toner is varied stepwise for individual colors to insure printing of a sharp image. The approach of performing sequential printing using toners in the decreasing order of melting point also proved to be effective in assuring the precision of paper feed, thereby reducing or even preventing the occurrence of "doubling" or color mismatch in multi-color printing.

As regards the assurance of precision in paper feed, it has been found to be very effective to minimize the expansion or shrinkage of the recording paper by setting the temperature of the respective paper feed guides at a certain value, say, 100° C., both between adjacent units of the monochromatic recording apparatus 20 and immediately before the entrance of paper into the first unit of the monochromatic recording apparatus 20. This also enabled the printing in full colors on plain paper, although the image quality obtained deteriorated slightly. The temperature of feed guides is also related to the glass transition point of toner but basically it may be set to the temperature occurring just before the recording paper carrying the toner image separates from the dielectric belt 4 being cooled with the integral heating/cooling unit (consisting of heater 1 and cooler 3). The temperature at that point is substantially equal to the glass transition point of toner.

The above-described idea of completing the printing of individual colors to have them printed successively one on another, and the elimination of offsetting by separating the recording paper carrying the toner image from the dielectric metal belt 4 after the molten toner has been thoroughly cooled have offered a method by which the development of a new color printer is greatly facilitated. Stated more specifically, the elimination of offsetting by a physical means consisting of cooling and recording paper separation will markedly reduce the severity in chemical materials characteristics required for the toner, whereas the practice of completing the printing of individual colors to have them printed successively one on another substantially obviates the need for selecting toners that have the same melting point and which are protected against color mixing in a molten state. As a further advantage, the multi-color printing process adopted in the present invention comprises in effect the repetition of printing cycles for monochromatic colors; the technique that is especially needed in achieving multi-color printing is to insure the precision of paper feed but this is in no way different from the requirement of the prior art system.

The sole limitation on the color printing method implemented by the apparatus shown in FIG. 8 is that the printing speed of the system should be reduced in such a way that each printing unit operates at a slower speed than the preceding unit in order to prevent the enhancement of "doubling" automatically.

In accordance with the present invention, an electrophotographic recording apparatus is realized in which the photoreceptor can be used for an almost indefinite period and thermal fixing can be performed in an offsetless manner to insure easy maintenance in that the sole item of maintenance work is to replenish the toner which is one of the consumables. As a further advantage, only one cycle of simultaneously performing transfer and fixing operations need be performed on the recording paper to complete the recording process and recording can be easily accomplished on various kinds of recording paper, as well as on envelope paper with which considerable difficulty has been encountered in printing by the prior art system. The electrophotographic recording apparatus of the present invention has such a simple mechanistic design that it offers great benefits in practical applications as exemplified by small size, low cost and high reliability.

A multi-color printing electrophotographic recording system in which a plurality of units of the recording apparatus described above are connected in a linear array can be used as the first model ever developed of a color printer that features easy maintenance. In addition, this enables a satisfactory color printer to be developed without being bothered by the possible interference between toners for different colors. Further, this recording system has such a simple mechanistic design that it offers great benefits in practical applications as exemplified by small size, low cost, high reliability and easy maintenance.

What is claimed is:

1. An electrophotographic recording apparatus, comprising:

a photoreceptor having a photoconductive light-sensitive layer;

an optical head provided in the vicinity of said photoreceptor, exposure being performed on said photoreceptor in response to a signal from said optical head;

a dielectric belt comprising a thin endless metal belt having a dielectric layer on an outer peripheral surface, said dielectric belt being brought into contact with said photoreceptor to form an electrostatic latent image on the dielectric belt in successive correspondence with an image formed on said photoreceptor;

a developer for developing the electrostatic latent image with a toner to produce a toner image;

transfer means for transferring said toner image onto a transfer medium; and fixing means for permanently fixing said toner image on said transfer medium to record a final image.

2. An electrophotographic recording apparatus according to claim 1, further comprising an integral heating/cooling unit which is pressed against an inner surface of said dielectric belt so brought into contact with the transfer medium, whereby the toner image on said dielectric belt is sequentially melted, that said dielectric belt is

3. An electrophotographic recording apparatus according to claim 2, in which the photoreceptor comprises a transparent substrate coated with a clear electroconductive film and has the photoconductive light-sensitive layer provided on an outer peripheral surface, a voltage being applied between the clear electroconductive film on said photoreceptor and the dielectric belt, exposure being performed on a portion of the photoreceptor in contact with said dielectric belt in response to a signal as applied from the optical head disposed on a side of said photoreceptor opposite said dielectric belt, whereby an electrostatic latent image is formed on said dielectric belt, said latent image then being developed with a toner, said integral heating/cooling unit being pressed against the inner surface of said metal belt so that said dielectric belt is brought into contact with the transfer medium, whereby the toner image is melted, transferred and fixed on said transfer medium to record said final image.

4. An electrophotographic recording apparatus according to claim 1, wherein said photoreceptor comprises an endless transparent substrate, the photoconductive light-sensitive layer being formed on an outer peripheral surface of said transparent substrate and a light-shielding member provided on at least an outer peripheral surface of said photoconductive light-sensitive layer, said optical head being disposed inside said photoreceptor.

5. An electrophotographic recording apparatus according to claim 3, wherein a clear electroconductive film is also coated on a surface of an inner, peripheral side of the endless transparent substrate, said clear electroconductive film being at all times grounded electrically.

6. A multi-color printing electrophotographic recording system comprising two or more electrophotographic recording units, each of said units comprising:

a photoreceptor having a photoconductive light-sensitive layer;

an optical head provided in the vicinity of said photoreceptor, exposure being performed on said photoreceptor in response to a signal from said optical head;

a dielectric belt comprising a thin endless metal belt having a dielectric layer on an outer peripheral surface, said dielectric belt being brought into contact with said photoreceptor to form an electrostatic latent image on the dielectric belt in successive correspondence with an image formed on said photoreceptor;

a developer for developing the electrostatic latent image with a toner to produce a toner image;

transfer means for transferring said toner image onto a transfer medium; and fixing means for permanently fixing said toner image on said transfer medium to record a final image, and wherein said two or more electrophotographic recording units are arranged in series such that individual colors are printed successively one on another.

7. A multi-color printing electrophotographic recording system according to claim 6, in which sequential printing is completed using toners in a decreasing order of melting point.

8. A multi-color printing electrophotographic recording system according to claim 6, in which a temperature of respective guides for feeding recording paper both between adjacent units of the electrophotographic recording system arranged in series and immediately before an entrance of the recording paper into a first unit of the recording system, is set to a value close to a glass transition point that is a lowest glass transition point of all toners to be used.

9. A multi-color printing electrophotographic recording system according to claim 6, in which a speed of recording with the units of the electrophotographic recording systems arranged in series is reduced such that each sucessive recording unit operates at a slower speed than a preceding recording unit.

10. A multi-color printing electrophotographic recording system according to claim 6, in which two or more units of the electrophotographic recording system are arranged in series in a geometric pattern so that maintenance jobs including toner replacement and removal of jammed paper can be executed easily.

* * * * *